US009271587B2

(12) United States Patent
Newby

(10) Patent No.: US 9,271,587 B2
(45) Date of Patent: Mar. 1, 2016

(54) HANGING VESSEL

(76) Inventor: Thomas Owen Newby, Wilmington, DE (US)

( * ) Notice: Subject to any disclaimer, the term of this patent is extended or adjusted under 35 U.S.C. 154(b) by 1713 days.

(21) Appl. No.: 12/283,839

(22) Filed: Sep. 16, 2008

(65) Prior Publication Data

US 2009/0114789 A1 May 7, 2009

Related U.S. Application Data

(60) Provisional application No. 60/960,111, filed on Sep. 17, 2007.

(51) Int. Cl.
*A47K 1/08* (2006.01)
*A47G 7/06* (2006.01)
*A47G 7/04* (2006.01)

(52) U.S. Cl.
CPC . *A47G 7/06* (2013.01); *A47G 7/044* (2013.01)

(58) Field of Classification Search
CPC ..... A47G 7/06; A47G 7/044
USPC ..... 248/318, 302, 309.1, 211.2, 303, 305, 248/210; 47/67, 65.5, 45; 202/216; D6/566, D6/565
See application file for complete search history.

(56) References Cited

U.S. PATENT DOCUMENTS 173,480 A * 2/1876 Lee ..... A01G 5/04 206/423
643,229 A * 2/1900 Mitchell ..... B65H 49/08 220/490
2,864,575 A * 12/1958 Stewart ..... A61J 9/06 248/103
3,589,338 A * 6/1971 Lovitz ..... A01K 1/0356 119/51.01
3,955,682 A * 5/1976 Baren ..... B01L 9/00 211/74
4,131,259 A * 12/1978 Franks ..... A47G 7/044 211/75
4,143,845 A * 3/1979 Harris ..... A47F 5/0815 248/220.43
4,603,507 A * 8/1986 Nelson ..... A47G 7/044 211/113
D332,888 S * 2/1993 Cook ..... D6/674
D337,226 S 7/1993 Rosenbaum
5,263,274 A * 11/1993 Speed ..... A01M 31/008 222/108
5,402,899 A * 4/1995 Ammeson ..... B67D 3/0083 215/391
D367,998 S * 3/1996 Graw ..... D7/620
5,586,413 A * 12/1996 Sharon ..... A47G 7/025 211/119
D424,471 S * 5/2000 Souris ..... D11/146
D474,943 S * 5/2003 Olsen ..... D3/315
D487,862 S * 3/2004 Tincher ..... D7/620
6,854,210 B2 * 2/2005 Gunderman ..... A47G 7/025 47/39
D533,107 S * 12/2006 King ..... D11/152
7,354,225 B1 * 4/2008 Cohen ..... G06F 19/00 40/645
2003/0146353 A1 * 8/2003 Elliott ..... A01K 63/006 248/156
2004/0025425 A1 * 2/2004 Ramirez ..... A01G 9/12 47/41.01

* cited by examiner

*Primary Examiner* — Christopher Garft
(74) *Attorney, Agent, or Firm* — F. Brice Faller

(57) ABSTRACT

A hanging vessel includes a hanger and a containment vessel shaped as a solid of rotation having a central axis, a closed bottom, an open top, and a lower sidewall with a diameter that increases from the bottom upward. The hanger includes a first hoop located around the lower sidewall, and a second hoop located above the first hoop. The first and second hoops are open hoops having respective first and second gaps, and are connected by an intermediate section aligned with a tensile section extending from the second hoop to an attachment point on the axis above the open end. An alternative hanger has helical turns conforming to the vase. The hanger is preferably formed from a single piece of resilient wire. The vessel may be a vase having a bulbous portion that can be positively retained by the hoops or turns.

15 Claims, 6 Drawing Sheets

FIG.4
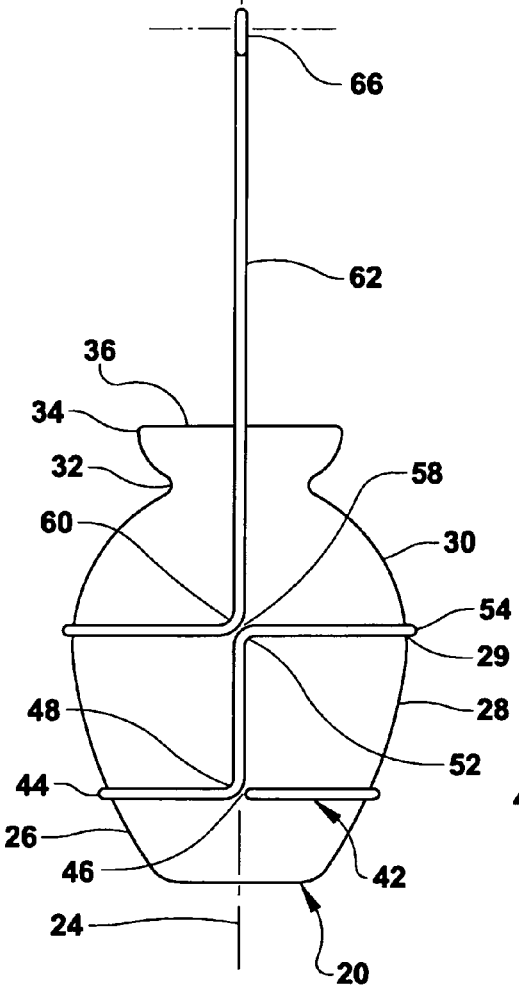
FIG.5
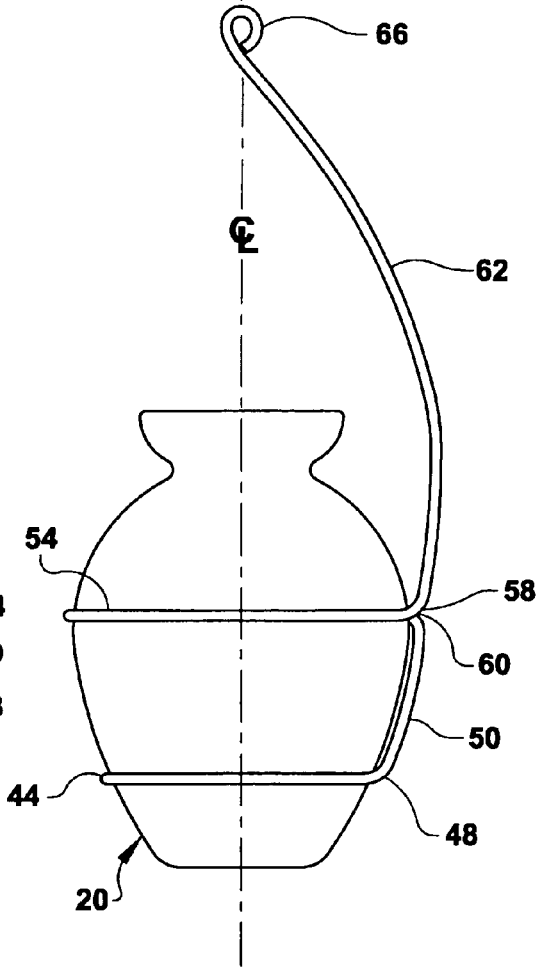
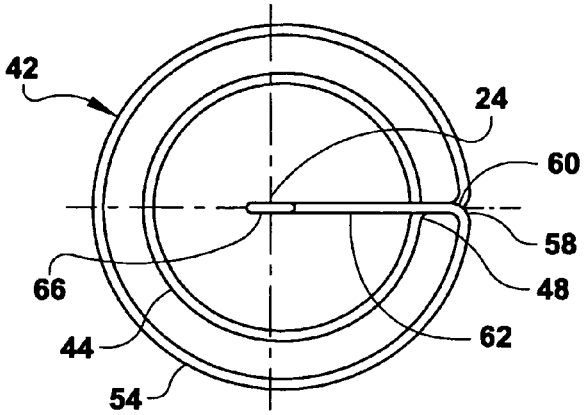
FIG.6

HANGING VESSEL

FIELD OF THE INVENTION

The present invention relates to a hanging vessel including a hanger and a containment vessel such as flower vase, and particularly to a hanging vessel that is suitable for suspending in a mobile.

DESCRIPTION OF THE RELATED ART

Fresh cut flowers are usually displayed with their stems immersed in water contained in a vessel such as a glass vase, and placed on a tabletop or other horizontal surface. Alternatively, fresh cut flowers are occasionally displayed in wall mounted sconces or incorporated into wreaths or bunting hung against vertical surfaces. In each of these examples the flower arrangements are largely static compositions, grounded to a fixed surface and, with the exception of table centerpieces, mostly designed to be seen from a limited vantage point.

U.S. Pat. No. D337,226 discloses a hanging flower pot holder for a standard flower pot shaped as a truncated cone having a collar. The hanger is formed with a single hoop that surrounds the pot below the collar, and a tensile section extending upward from the hoop to a hook formed on the axis of the pot. While suitable for a very specific flower pot, the hanger would not provide stable support for a containment vessel such as a vase not having a collar for the hoop to rest against.

U.S. Pat. No. 4,131,259 discloses a swinging cup holder formed from a single piece of wire and having an encircling ring for surrounding a cup, a supporting base that supports the bottom of the cup, and a spine portion connecting the ring to the base. The spine portion also extends above the ring to a hook above the cup. According to an alternative embodiment, the cup holder is formed in a helical configuration wherein the lowermost turn forms the cup-supporting base. The disclosed cup holders would not be useful with a vase or other containment vessel not having a flat bottom.

U.S. Design Pat. No. D487,862 discloses a cup holder formed with a helical coil with turns having a radius of curvature which increases toward the top turn, and a hanger for supporting the coil on an upright member to the side of the coil. Here too the lowermost turn appears to form a cup-supporting base. The cup holder is only suitable for holding a cylindrical or frustoidal cup.

SUMMARY OF THE INVENTION

The hanging vessel according to the invention utilizes a containment vessel shaped as a solid of rotation having a central axis, a closed bottom, an open top, and a lower sidewall having a diameter that increases from the bottom toward the top. Preferably, the vase is made of clear glass and has the shape of a classic amphora without handles, with a narrow neck that limits the possibility of spillage. However the invention encompasses a variety of other materials and shapes of vessel.

The containment vessel is supported by a hanger having first and second hoops conforming to the vessel around axis, the first hoop located around the lower sidewall, the second hoop located above the first hoop. The first and second hoops are preferably open hoops having respective first and second gaps, the hoops being connected by an intermediate section. A tensile section extends from the second hoop to an attachment point on the axis above the open end. The hanger is preferably formed from a single piece of wire so that the intermediate section and the tensile section are aligned on a common arc that intersects the axis of the vessel at a point directly over the open top and roughly half the overall height of the vessel. At this point the hanger is formed with a loop providing an attachment for a suspension line.

The current invention expands upon the prior art by providing means for suspending fresh cut flower arrangements in free space. Individual vessels supported from above allow for the placement of fresh cut flowers in new and unique ways, creating floral displays that seem to be floating in air. By incorporating multiple vessels within a balanced kinetic structure, supported from above, individual components of the display are free to move and reposition in relation to the other elements. The result is a dynamic floral composition.

This effect is provided by a configuration of one or more vessels, each able to maintain a selection of fresh cut flowers with their stems immersed in water, and each suspended from a single line, such as a length of clear monofilament, so that each vessel is free to rotate on its axis. The suspended vessel can be displayed as a single element suspended from an overhead attachment such as a hook in the ceiling or window frame, or as a plurality of vessels incorporated into a self-balancing kinetic support system such as a mobile.

The benefits and advantages of the invention extend beyond the unique nature of the display to addressing other practical considerations. These include providing the means to display fresh cut flowers in locations that were previously unavailable, such as suspended in windows and doorways, in high traffic areas such as stairwells and breezeways, and out of the reach of pets and small children. In addition, the invention provides greater versatility in establishing the height and vantage point of arrangements including the placement of flowers at eye level in a way that is not normally possible with table based displays. Also, the invention allows for the use of flowers and foliage with shorter stems than is commonly required for standard vases. This provides the opportunity to effectively use material such as flowers with broken stems that might otherwise be discarded. Finally, the invention provides for the easy removal and replacement of the individual vessels from the support structure for cleaning and refreshment of its contents. In this way, individual flowers in an arrangement can be replaced without disrupting the entire display.

In addition to displaying fresh cut flowers, the merits and advantages of the invention can easily extend to a variety of other uses. These include, but are not limited to, the display of artificial and dried floral material, living plants, candles, live fish, scented material such as potpourri, sand art, colored water, and aggregates of items such as glass marbles, pine cones, or seashells.

In a kinetic arrangement of hanging vessels, each can rotate on its own axis and move in relation to the other vessels around it, creating a dynamic display. The basic design can be applied to numerous configurations, including but not limited to the following:

(1) A single vessel supported by a bent wire structure and suspended on a single vertical line attached to an overhead connection, such as a hook in the ceiling or window frame or a bracket extending from the wall or other architectural element. The vessel is free to rotate on its own vertical axis.

(2) A plurality of individual vessels attached to a plurality of overhead connections and positioned at equal or varying heights such that they are each free to rotate on a respective vertical axis.

(3) A plurality of individual vessels attached to a single overhead connection, positioned at equal or varying heights and held at a consistent distance from one another by a horizontal structural member, such as a ring or a plurality of rigid members radiating from a fixed center, where in each vertical line is attached to or passes through the horizontal structure at a point between the vessel and the overhead connection. Each vessel is thus free to rotate on its own vertical axis and to orbit collectively around a central vertical axis in line with the single overhead connection.

(4) A plurality of individual vessels attached to a single rigid horizontal member with a separate vertical line attached to the rigid member and attached to an overhead connection such that the vessels are balanced and maintain a consistent relative height and position. Each vessel is free to rotate on its own axis and to orbit collectively around the central vertical axis in line with the single overhead connection.

(5) A plurality of individual vessels as described in variation 4 wherein the number of vessels is two and the horizontal member is a crossbar. The vertical lines attached to the two vessels are attached to the opposite ends of the crossbar and the vertical line attached to the overhead connection is attached to a midpoint.

(6) An arrangement of three vessels suspended from an upper crossbar with attachments on opposite ends, one end supporting a configuration of two vessels as described in variation 5 and the other end supporting a single vessel as described in variation 1. A single vertical line is attached to the upper crossbar at a point roughly ⅓ the distance from the attachment of the vertical line supporting the two vessels and ⅔ the distance of the vertical line supporting the single vessel in such a way that all three vessels are balanced and maintain a consistent relative height. The individual vessels are free to rotate about their own vertical axes, the two joined vessels are free to orbit around the axis at one end of the crossbar, and all three vessels are free to orbit around the axis in line with overhead connection.

(7) A single vessel, as described in variation (1), wherein the vertical line is attached to one end of a crossbar with a counterweight on other end. The crossbar is supported by an overhead connection so that the vessel, when filled with water, is in balance with the counterweight. The vessel is thus free to rotate on its own axis and to orbit around an axis in line with the overhead connection. Over time, the height of the vessel and the angle of the counterbalance structure will change in relation to the ground, depending upon the amount of water that has evaporated. This will provide a visual indicator of when to replenish the water in the vessel.

BRIEF DESCRIPTION OF THE DRAWING

FIG. 4 is a front elevation view of a single hanging vessel;

FIG. 5 is a side elevation view of a single hanging vessel;

FIG. 6 is a plan view of the hanger alone;

DETAILED DESCRIPTION OF THE PREFERRED EMBODIMENTS

Figure 1:
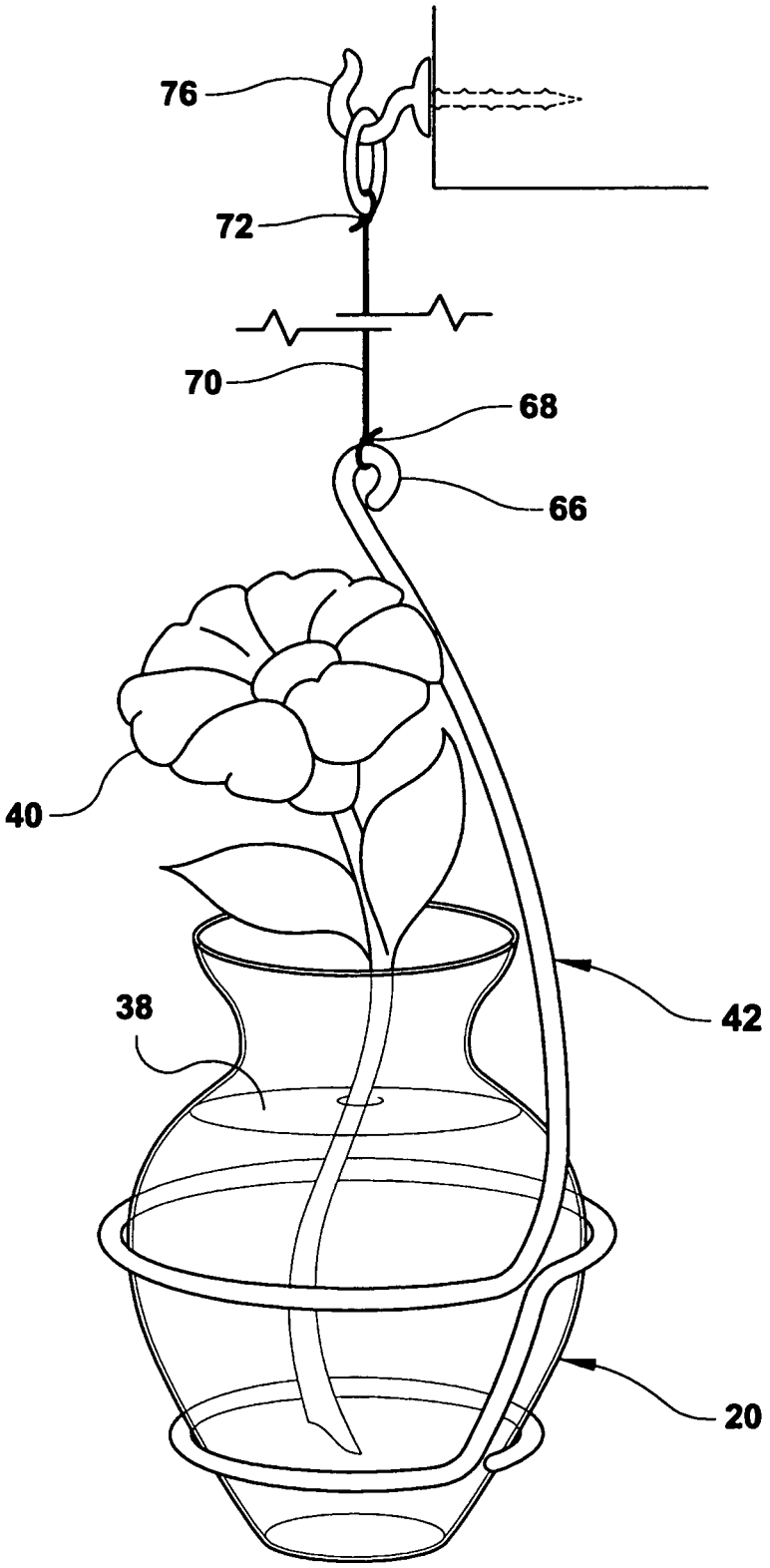
FIG. 1 is a perspective elevation view of a single hanging vessel according to the invention in use.

Referring to FIG. 1, the basic elements of the hanging vessel according to the invention are a containment vessel 20 and a hanger 42 which can be suspended from a hook 76 by a suspension line 70. The line 70 may be a cable, braided cord, or monofilament line. It could also be a chain, which would obviate the need for knots 68, 72. The containment vessel 20 is preferably a clear glass vase capable of holding water 38 and a fresh cut flower 40. As best seen in FIGS. 4-6, the vessel 20 is shaped as a solid of rotation having a central axis 24, a closed bottom 26, and an open top 36. The diameter increases from the bottom 26 through lower sidewall 28 to a maximum diameter at bulbous mid-section 29. Above midsection 29 the diameter decreases through an upper sidewall 30 to neck 32, then increases through flared section 34 to top opening 36. This resembles the shape of an amphora, wherein the narrow neck limits the possibility of spillage. The vessel is not limited to this material or shape, and may be plastic, ceramic, porcelain, terracotta, metal, wood, mesh, or woven material.

Figure 9:
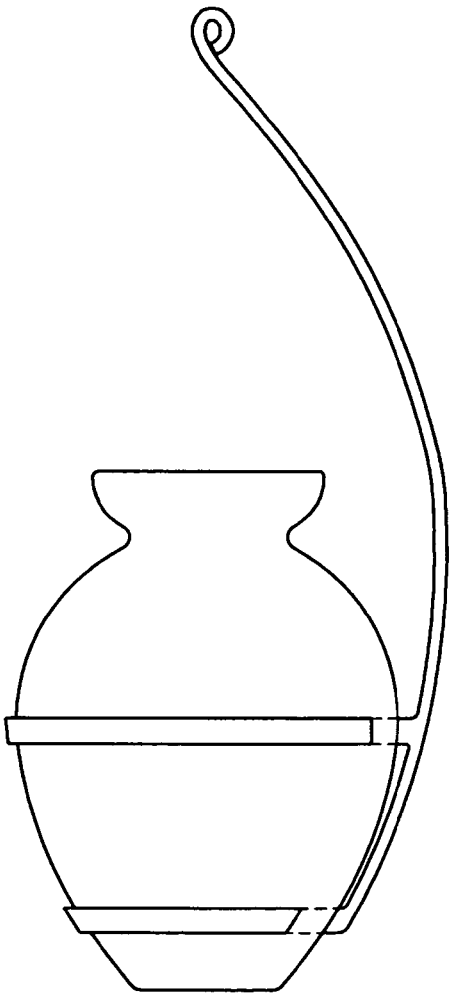
FIG. 9 is a side elevation view of a hanging vessel according to the invention having an alternative hanger.

The hanger 42 is preferably formed from single piece of resilient metal wire, such as music wire or copper alloy wire. The wire may formed by bending on a mandrel, as is well known, so that the final shape conforms to the containment vessel. The hanger is not limited to a single piece of wire, but may incorporate brazed pieces as shown in FIG. 9. The hanger could also be made of other resilient material, such as injection molded plastic. The hanger 42 of FIGS. 1-7 includes first and second circular hoops 44, 54 with geometric centers on the central axis 24, the hoops 44, 54 lying in planes perpendicular to the axis 24. The first or lower hoop 44 is formed to a prescribed diameter such that it makes direct contact with tapered wall 28, thus supporting the weight of vessel 20 and its contents 38, 40. The first hoop 44 is an open hoop having a first gap 46 bounded by a first right angle bend 48, from which intermediate section 50 extends. The section 50 is curved to follow the contour of the vessel 20 and extends longitudinally, i.e. along a "line of longitude", to a second right angle bend 52 bounding a gap 58 in second hoop 54. The second or upper hoop 54 is also formed to a prescribed diameter, so that it conforms to the vessel. The second hoop 54 makes contact with vessel 20 near midsection 30 and thus stabilizes the vessel 20, keeping it upright. The vessel nests inside the hoops 44, 54 such that it is easily removed by lifting it up.

Figure 7:
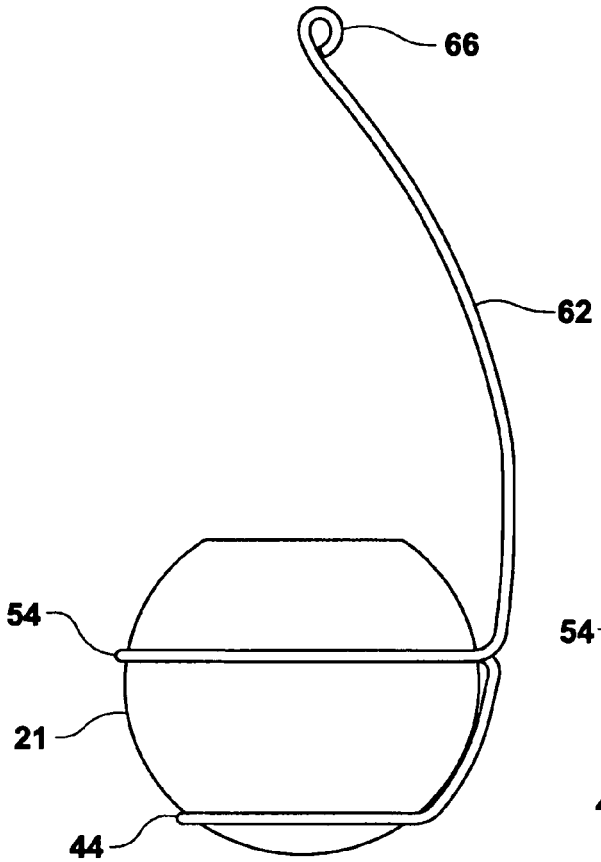
FIG. 7 is a side elevation view of a hanging vessel according to the invention having an alternative containment vessel.

According to an important variation, the second hoop 54 is formed to have a diameter smaller than the midsection 29 of the vessel, and engages the vessel resiliently above the largest diameter of the vessel, as shown in FIG. 7. The vessel is therefore positively retained in the hoops, and cannot be dislodged unless the upper hoop 54 is expanded by opening the gap 58. While the gaps may be bridged by welds or the like so that the hoops are closed and rigid, this would preclude resilience in the hoops, and would thus preclude this embodiment.

The second hoop 54 extends from second bend 52 to a third right angle bend 60 to connect with tensile section 62 by which the vessel is suspended. The tensile section 62 is aligned with intermediate section 50 to form a linear arc having a center of curvature opposite the central axis 24 in a plane encompassing the axis 24. The tensile section 62 intersects the axis 24 at a point directly over the top opening 36 at a height roughly equal to ⅔ the overall length of the container.

The tensile section 62 is formed with a wire loop 66, which serves as an attachment point for the hanger 42. The loop 66 is preferably formed in the opposite direction from the arc of the tensile section 62, directly above the point where tensile section 62 intersects the central axis 24. A line 70 attached to the top of the wire loop 66 therefore extends coaxially with the vessel 20 when supporting the weight of the suspended vessel 20.

The lower end of line 70 is tied to loop 66 at knot 68, while the upper end is tied to a ring 74 at knot 72. The ring 74 can be hung on a hook 76 in the ceiling, window frame, bracket or other overhead architectural element. Of course the line 70 can also be knotted to form a loop for engaging the hook.

Figure 2:
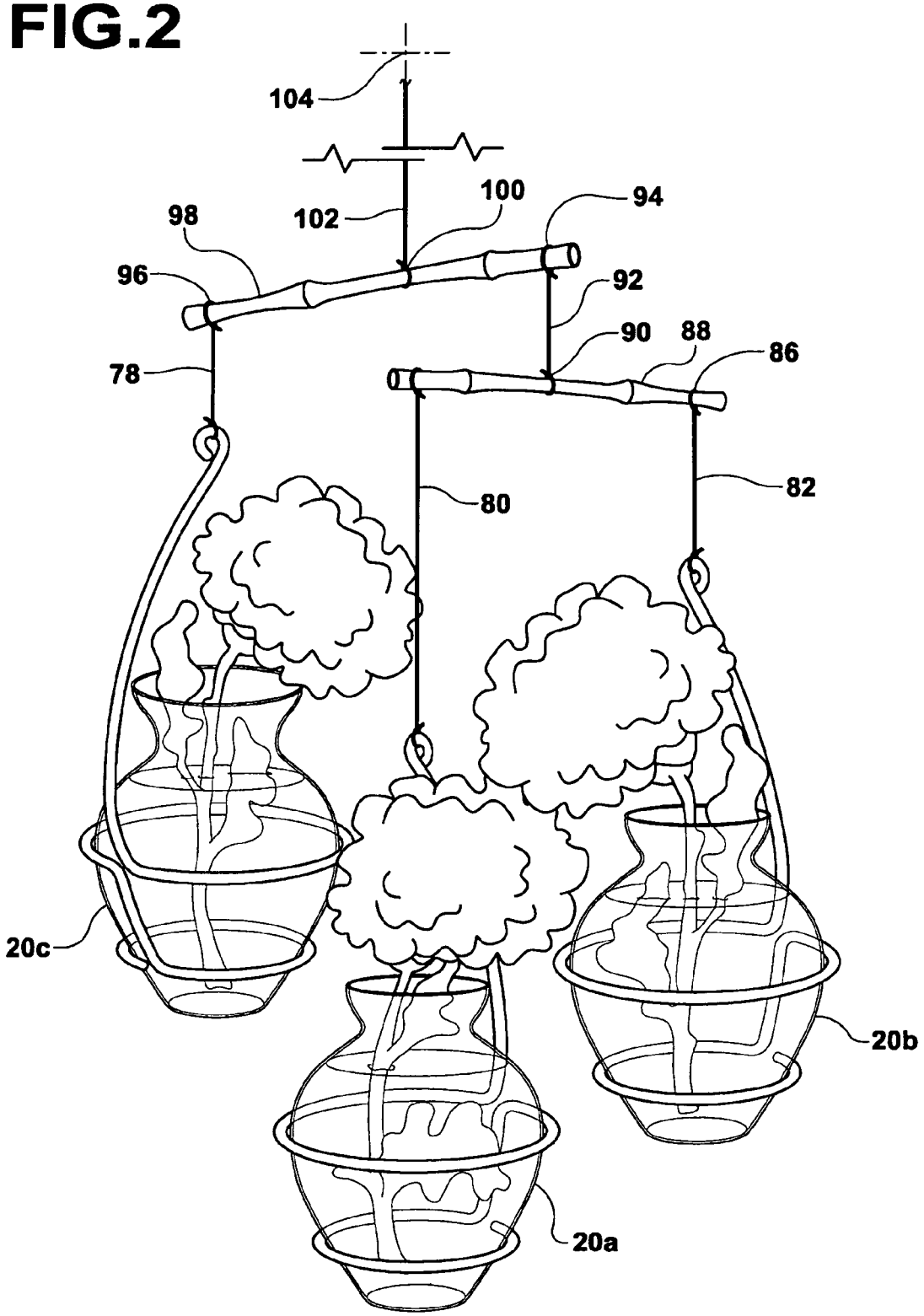
FIG. 2 is a perspective elevation view of a plurality of hanging vessels according to the invention in use in a mobile.

FIG. 2 shows a plurality of hanging vessels suspended in the balanced arrangement of a mobile. All of the suspension lines 78, 92, 80, 82 are prescribed lengths of cable, braided cord or monofilament line and the rigid crossbars 88, 98 are rods, wooden dowels, plastic or natural structural material such as bamboo. In the configuration shown two vessels 20*a*, 20*b* are suspended by the upper attachment of their respective lines 80, 82, at attachment points 84, 86 on opposite ends of crossbar 88. The lower attachment of line 92 is affixed to the attachment point 90, at the midpoint between attachment points 84 and 86 on crossbar 88 such that when the combined weight is support through line 92, the individual suspended vessels 20*a* and 20*b* are held in balance and crossbar 88 remains substantially horizontal. The line 92 is affixed to crossbar 98 at upper attachment 94 directly over lower attachment 90. A third suspended vessel 20*c* is attached to line 78 which is affixed to crossbar 98 at upper attachment 96 on the end directly opposite to upper attachment 94. Suspension line 102 is affixed to crossbar 98 at lower attachment 100, roughly ⅓ the distance from upper attachment 94 and ⅔ from attachment point 96, in such a way that the first and second suspended vessels 20*a* and 20*b* and their contents are held in balance with the third suspended vessel 20*b* and its contents. The line 102 extends to upper attachment 104, where it is secured on a hook 76 in the ceiling, window frame, bracket or other overhead architectural element.

FIG. 2 also illustrates alternative bending arrangements for the hangers. In the hanger of suspended vessel 20*b*, the first and second hoops extend circumferentially from the intermediate section in opposite rotational directions. In the hanger of suspended vessel 20*c*, the first and second hoops extend circumferentially from the intermediate section in the same rotational direction (counterclockwise, as seen from above).

Figure 3:
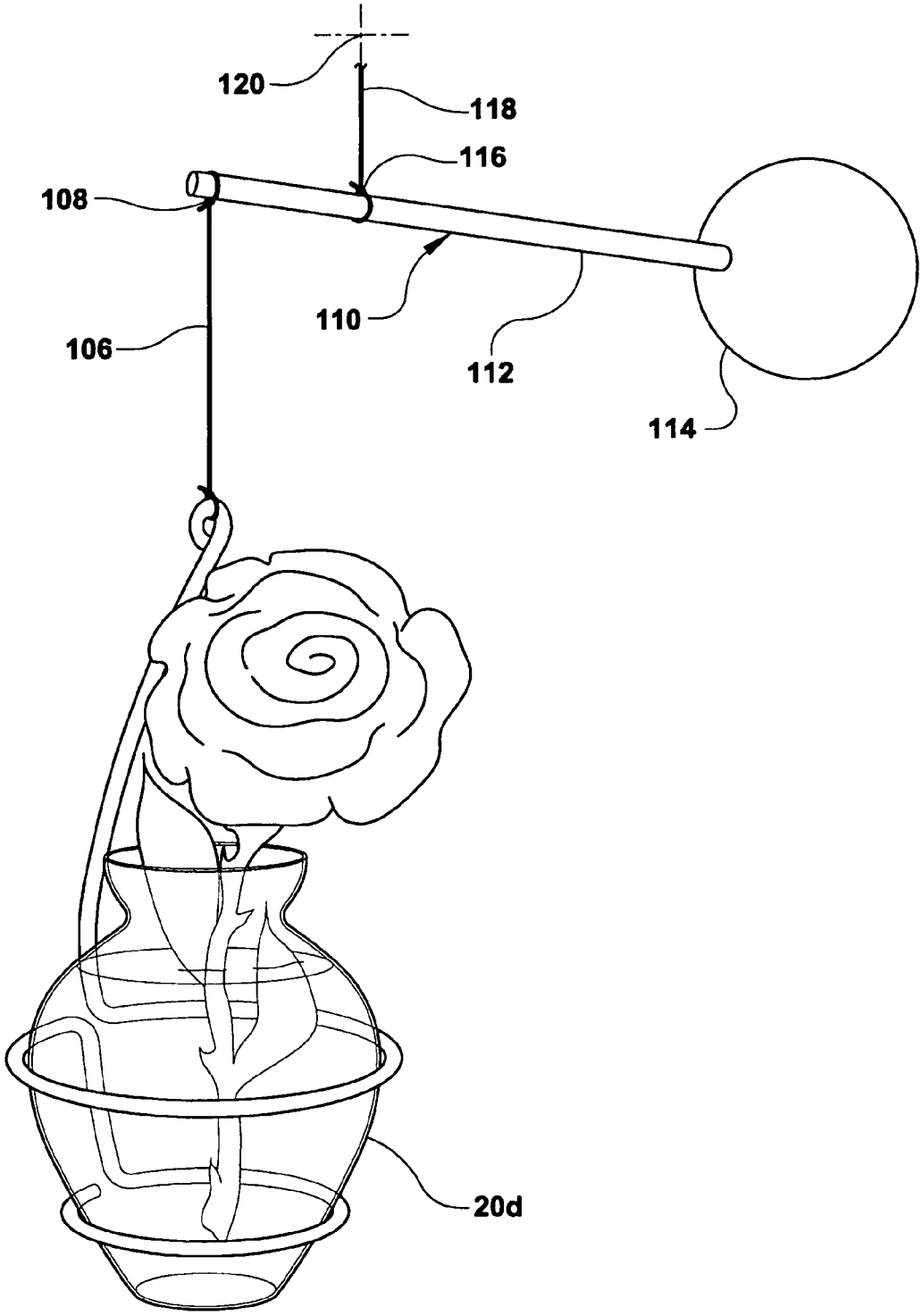
FIG. 3 is a perspective elevation view of a single hanging vessel according to the invention in use with a counterweight.

FIG. 3 shows a single suspended vessel 20*d* with a counterbalance structure 110 including a rigid crossbar 112 and a counterweight 114, in the example shown a ball of prescribed mass, mounted on one end. Suspended vessel 20*d* is attached to suspension line 106 affixed to crossbar 112 at upper attachment 108 on the end directly opposite counterweight 114. A line 118 is attached to crossbar 112 at lower attachment 116 between upper attachment 108 and counterweight 114 such that the suspended vessel 20*d* and its contents are held in balance with the counterweight. Suspension line 118 extends to upper attachment 120 where it connects with a ring or loop 74 which is secured on a hook 76 in the ceiling, window frame, bracket or other overhead architectural element.

In general, the arrangement of hanging vessels in a balanced mobile or counterweight arrangement will follow the basic law of moments, wherein length times weight on either side of a suspension-point must be equal. To assist in securing the lines at the desired suspension points, the crossbars may be provided with a series of notches.

Figure 8:
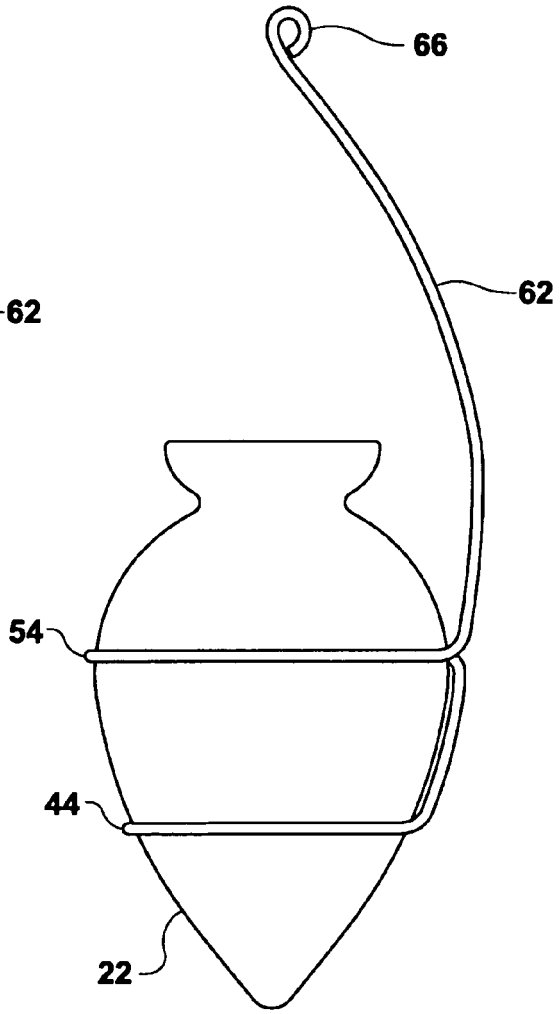
FIG. 8 is a side elevation view of a hanging vessel according to the invention having another alternative containment vessel.

FIGS. 7 and 8 show containment vessels 21, 22 having alternative shapes. In FIG. 7, the containment vessel 21 is substantially spherical with an open top. Here the second hoop 54 is above the maximum diameter of the vessel 21, so that the vessel is positively retained between the first and second hoops. This arrangement is not limited to the globular shape, but may apply to any bulbous shape or other shape having a midsection with a maximum diameter. FIG. 8 shows a containment vessel having a pointed bottom. This illustrates an important feature of all described embodiments, which is the lack of any bottom support. That is, the containment vessels are supported exclusively by the hoops, where at least the bottom hoop conforms to the lower sidewall and supports the weight of the vessel.

In the embodiments shown, the top or second hoop has a larger diameter than the bottom or first hoop. However, where the top hoop is above the maximum diameter, as shown in FIG. 7, the hoops may be the same size. For some shapes of the containment vessel, it is even conceivable that the top hoop has a smaller diameter than the bottom hoop.

While the hanging vessel according to the invention is most economically realized by forming the hanger from a single piece of wire, it can also be realized by brazing or otherwise fixing two open hoops to an arcuate section that forms both the intermediate section and the tensile section. This is illustrated in FIG. 9. From an aesthetic standpoint, it is desirable in all cases for the intermediate section to be linearly aligned with the tensile section in a single arc.

In the embodiments described above, two hoops have been illustrated in every case. However it will be understood that the hanging vessel according to the invention can be realized utilizing more than two hoops.

Figure 10:
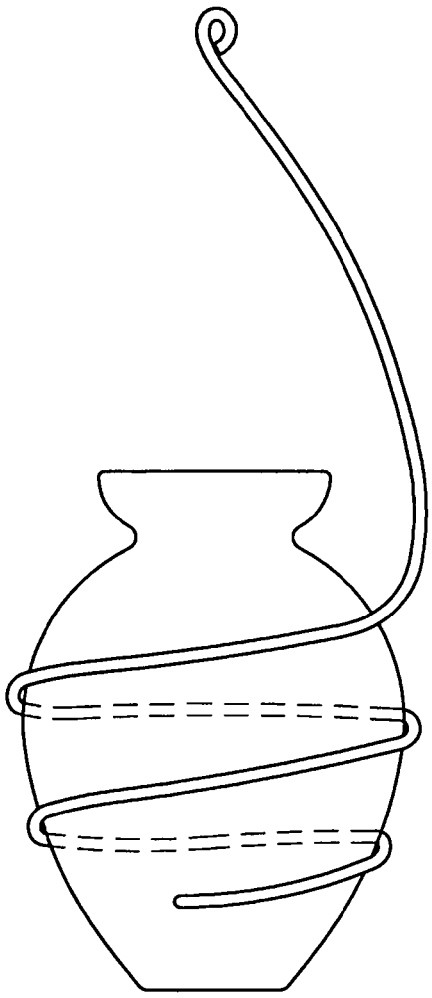
FIG. 10 is a side elevation view of a hanging vessel according to the invention having another alternative hanger.

FIG. 10 illustrates an important variation of the hanger that utilizes the turns of a helix to support the containment vessel. The turn toward the top of the containment vessel has a decreasing radius of curvature so that it conforms to the sidewall above the maximum diameter, and positively retains the containment vessel in the hanger. Since the hoops have been replaced by continuous helical turns, there is no intermediate section. However the containment vessel is supported in substantially the same manner.

The foregoing is exemplary and not intended to limit the scope of the claims that follow.

What is claimed is:

1. A hanging vessel comprising:

a containment vessel shaped as a solid of rotation having a central axis, the vessel having a closed bottom, an open top, and a lower sidewall having a diameter which increases from said bottom toward said top; and a hanger comprising first and second hoops conforming to said vessel around said axis, said first hoop located around said lower sidewall so that said first hoop lies radially outside said sidewall, said second hoop located above said first hoop, wherein said first and second hoops are open hoops having respective first and second gaps, said hoops being connected by an intermediate section, said hanger further comprising a tensile section extending from said second hoop to an attachment point on said axis above said open top;

wherein said containment vessel comprises a bulbous portion having a maximum diameter between said first and second hoops.

2. The hanging vessel of claim 1 wherein said first hoop has a first diameter and said second hoop has a second diameter which is larger than said first diameter.

3. The hanging vessel of claim 1 wherein said first and second hoops lie in respective first and second planes which are substantially normal to said axis.

4. The hanging vessel of claim 1 wherein said intermediate section extends from one side of said first gap to one side of said second gap, and said tensile section extends from another side of said second gap to said attachment point.

5. The hanging vessel of claim 1 wherein said hanger is formed from a single piece of wire.

6. The hanging vessel of claim 1 wherein said first and second hoops extend circumferentially from said intermediate section in opposite rotational directions.

7. The hanging vessel of claim 1 wherein said first and second hoops extend circumferentially from said intermediate section in the same rotational direction.

8. The hanging vessel of claim 1 wherein said intermediate section extends longitudinally between said first and second hoops, and said tensile section is linearly aligned with said intermediate section on a common arc.

9. A hanging vessel comprising:

a containment vessel shaped as a solid of rotation having a central axis, the vessel having a closed bottom, an open top, and a bulbous portion having a maximum diameter between said bottom and said top; and a hanger comprising first and second turns conforming to said vessel around said axis, said first turn located below said maximum diameter, said second turn located above said first turn, at least part of said second turn extending above said maximum diameter of said bulbous portion, said hanger further comprising a tensile section extending from said second turn to an attachment point on said axis above said open top, so that said open top lies between said second turn and said attachment point.

10. The hanging vessel of claim 9 wherein said first and second turns are formed as respective first and second open hoops having respective first and second gaps, said hoops being connected by an intermediate section extending from one side of said first gap to one side of said second gap, said tensile section extending from another side of said second gap to said attachment point.

11. The hanging vessel of claim 10 wherein said first and second hoops lie in respective first and second planes which are substantially normal to said axis.

12. The hanging vessel of claim 11 wherein said first and second hoops extend circumferentially from said intermediate section in opposite rotational directions.

13. The hanging vessel of claim 9 wherein said turns are formed as turns of a single continuous helix.

14. The hanging vessel of claim 9 wherein said hanger is formed from a single piece of wire.

15. The hanging vessel of claim 9 wherein the containment vessel is made of glass.

* * * * *